US011003141B2

(12) United States Patent
Piguet et al.

(10) Patent No.: US 11,003,141 B2
(45) Date of Patent: May 11, 2021

(54) CHRONOMETRIC TESTING DEVICE

(71) Applicant: Montres Breguet S.A., L'Abbaye (CH)

(72) Inventors: Rene Piguet, Cheseaux-sur-Lausanne (CH); Benoit Junod, Peillonnex (FR); Marc Stranczl, Nyon (CH)

(73) Assignee: Montres Breguet S.A., L'Abbaye (CH)

( * ) Notice: Subject to any disclaimer, the term of this patent is extended or adjusted under 35 U.S.C. 154(b) by 231 days.

(21) Appl. No.: 16/181,571

(22) Filed: Nov. 6, 2018

(65) Prior Publication Data

US 2019/0146420 A1 May 16, 2019

(30) Foreign Application Priority Data

Nov. 15, 2017 (EP) ..... 17201862

(51) Int. Cl.
*G04D 7/00* (2006.01)
*G04D 7/12* (2006.01)

(52) U.S. Cl.
CPC ..... *G04D 7/006* (2013.01); *G04D 7/004* (2013.01); *G04D 7/1264* (2013.01)

(58) Field of Classification Search
CPC ..... G04D 7/006; G04D 7/004; G04D 7/1264
USPC ..... 73/1.43, 1.45, 1.46, 1.48; 702/85, 89, 702/104; 968/748–752, 758–760, 968/769–771
See application file for complete search history.

(56) References Cited

U.S. PATENT DOCUMENTS 2,841,978 A * 7/1958 Kohn ..... G04D 7/006 73/1.52
2017/0060097 A1 3/2017 Depraz

FOREIGN PATENT DOCUMENTS

| | | |
|---|---|---|
| CH | 695 197 A5 | 1/2006 |
| CH | 699 301 A1 | 2/2010 |
| EP | 3 136 189 A1 | 3/2017 |

OTHER PUBLICATIONS

European Search Report dated Jun. 8, 2018 in European Application 17201862.4, filed Nov. 15, 2017 (with English Translation of Categories of Cited Documents).

* cited by examiner

*Primary Examiner* — Robert R Raevis
(74) *Attorney, Agent, or Firm* — Oblon, McClelland, Maier & Neustadt, L.L.P.

(57) ABSTRACT

A device that tests the chronometric precision of a watch movement or a watch includes a control device controlling a predefined cycle of motions passing through standard chronometric test positions, and a fine control device including a sequencer arranged to control the changes of chronometric test position of this movement, or respectively of this watch, in a multi-position sequence, after each measurement per position, and to start another multi-position sequence as soon as the preceding sequence finishes and which observes the predefined total duration of one cycle of several successive multi-position sequences. This sequencer is also arranged to manage the rate stabilisation durations, durations of measurement per position, and multi-position sequence durations.

20 Claims, 4 Drawing Sheets

CHRONOMETRIC TESTING DEVICE

CROSS-REFERENCE TO RELATED APPLICATION

This application claims priority to European Patent Application No. 17201862.4 filed on Nov. 15, 2017, the entire disclosure of which is hereby incorporated herein by reference.

FIELD OF THE INVENTION

The invention concerns a device for testing the precision of a watch movement or a watch, wherein said device includes at least one receptacle arranged to hold, up to a given acceleration threshold, at least one movement or one watch, and comprises manoeuvring means arranged for manoeuvring each said receptacle in space, arranged to impose on each said receptacle an overall cycle including at least one cycle that is predefined in terms of its trajectory and movement along said trajectory under the control of control means including a clock or connected to an external time base, and said cycle includes passing through standard chronometric testing positions.

The invention concerns the field of testing the chronometric precision of mobile timepieces, watches and marine chronometers or stopwatches.

BACKGROUND OF THE INVENTION

Testing the chronometric precision of a timepiece, particularly a watch, or of its movement, is essential to check the quality of the product released to the user. This testing is governed by official certification standards, established by recognized laboratories or observatories, which are unavoidable for placing products on the market.

Current chronometer tests measure the properties of the watch in static positions. Conventionally, tests are carried out in six test positions: two horizontal positions known as 'HH' (dial up—A), 'HB' (dial down—B) and four vertical positions: 'VB' (pendant down—C), 'VG' (pendant left—D), 'VH' (pendant up—E), 'VD' (pendant right—F).

Various acoustic measurement protocols are known to those skilled in the art.

A first type of measurement, called 0/24 hours, illustrated in FIG. 1, consists in taking measurements at 24 hour intervals, the first series with a fully wound mainspring, the second series after 24 hours of unwinding, each time in the six standard positions, with an acoustic measuring device, allowing a parameter 'm', consisting of the rate or amplitude, to be measured.

In this 0/24 hour measurement, the object to be tested (the watch, or movement, or watch head), which will be referred to hereinafter as a 'movement', is placed on the measuring device. A typical measurement is performed as follows: in the first position, 30 seconds of rate stabilisation, 2 minutes of measurement, then a change of position and the measurement is repeated in the remaining positions. This measurement, which takes several minutes in total, is performed with the mainspring fully wound ('0 h') and after 24 hours of unwinding ('24 h'). The movement is left on the workbench for 24 hours to wait for the mainspring to unwind, or the spring is unwound manually by a watchmaker by a number of turns equivalent to 24 hours of operation. The total measurement duration is short, since it is completed in approximately two times twenty minutes. However, no information is provided as to chronometric precision between the two measurements (instantaneous measurement).

To overcome this drawback, one solution consists in taking a measurement over 24 hours in each position, with the mainspring rewound at each change of position, as seen in FIGS. 2 and 3. The movement is placed on a measuring device similar to the 0/24 hour measuring device. A typical measurement is performed as follows: 30 seconds of rate stabilisation, 24 hours of measurement, then a change of position, winding the mainspring, and the measurement is then repeated in the remaining positions. The total measurement duration is long and takes 6 days. The advantage of this measurement over 24 hours is that it provides detailed information about chronometric precision between '0 hour' and '24 hours'. The drawback is, of course, the measurement duration, which results in a large number of parts undergoing testing, linked also to a large measurement database. FIG. 3 shows the superposition of the six measurements made in six positions, reduced to a single theoretical 24-hour cycle.

EP Patent Application No EP 3136189A1 in the name of ROLEX discloses a method for measuring chronometric precision and more specifically concerns the positions in which the watch or watch head is positioned during measurement. Chronometric tests simulate the various positions of the watch during a typical user's day.

EP Patent Application No 10192725 in the name of The Swatch Group Research & Development Ltd describes the chronometric tests using optical methods.

SUMMARY OF THE INVENTION

The invention intends to define chronometer testing criteria in order to accurately certify the watches produced, and to set in place suitable testing tools and methods.

To this end, the invention concerns a device.

The invention also concerns a method.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

The invention proposes to obtain more detailed information about chronometric precision than with a 0/24 hour measurement, by performing, for each standard position, a measurement spread over 24 hours, as well as with measurements made in the other positions, in order to drastically reduce the number of parts in the course of manufacture compared to a 24-hour measurement per position.

As a result of the device and fast measurement method, which has a total duration of around 24 hours, according to the invention, it is possible to obtain a complete, simulated characterization of the chronometric precision of the watch in several positions.

The advantages of the two traditional methods are combined: the rapidity of the 0/24 hour measurement, and the complete information of the 24-hour measurement per position.

Figure 1:
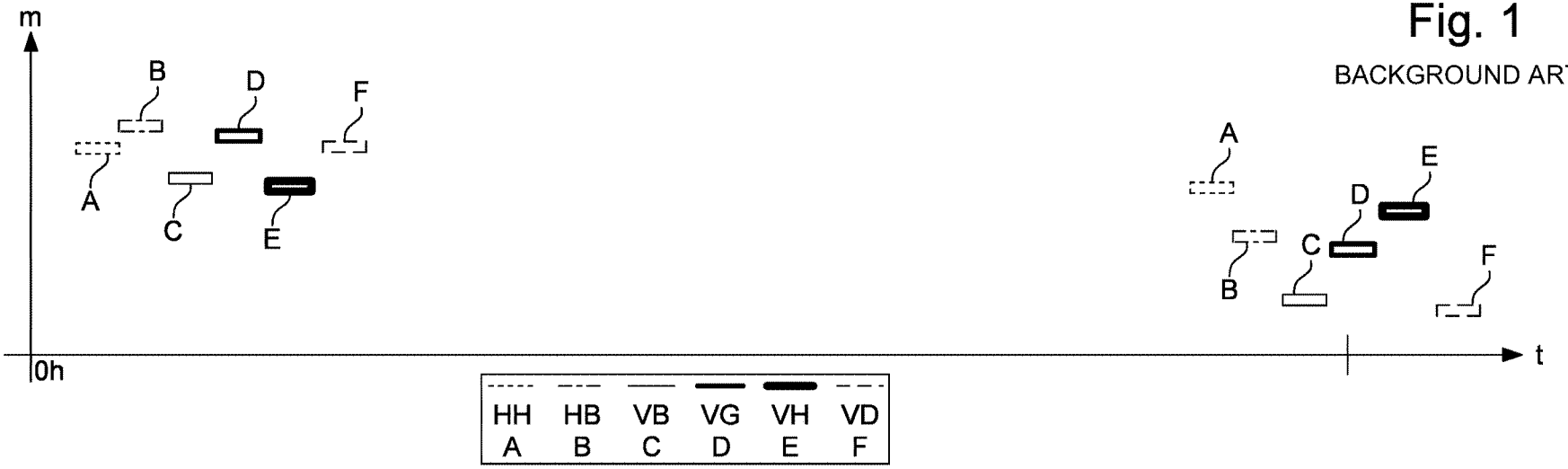
Fig. 1 BACKGROUND ART
FIG. 1 is a diagram, with time on the abscissa, and a rate or amplitude measurement on the ordinate, according to the first known type of rate measurement, called 0/24 hours, wherein the rate is measured successively in six standard positions, two times: at an instant 0 h with a fully wound mainspring barrel, and at an instant 24 h after a day of unwinding.
Figure 2:
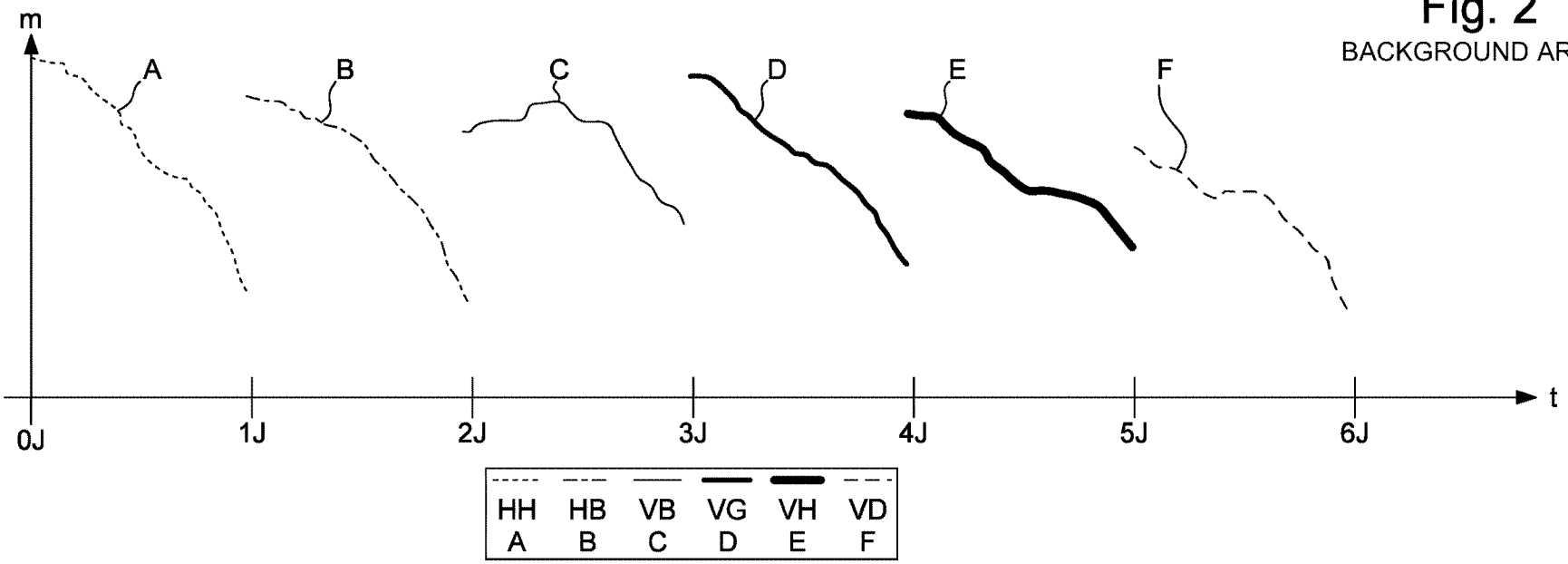
Fig. 2 BACKGROUND ART
FIG. 2 is a similar diagram to that of FIG. 1, according to a second known type of rate measurement, called the 24-hour measurement for each position, wherein the rate is measured successively in six standard positions, each time for 24 successive hours.
Figure 3:
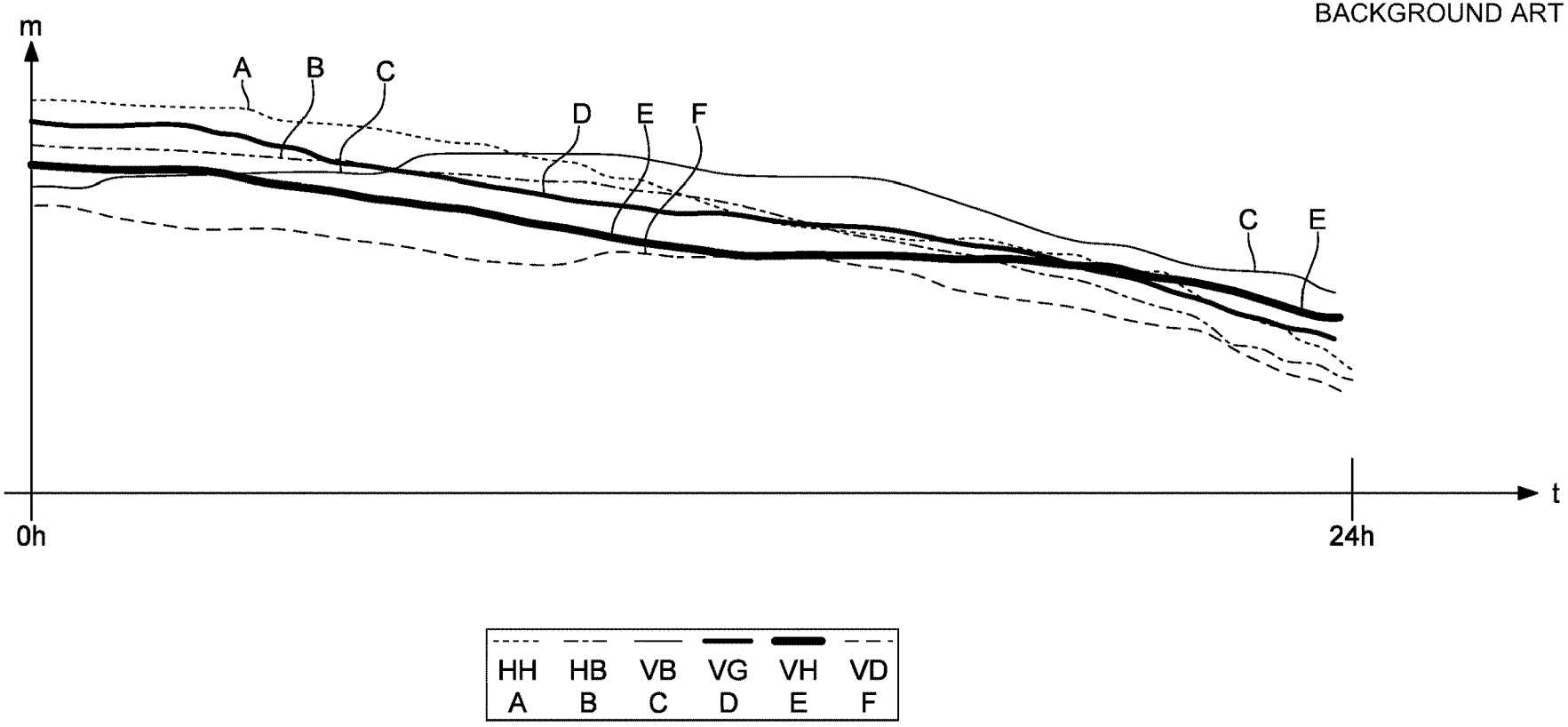
Fig. 3 BACKGROUND ART
FIG. 3 shows the superposition of the six graphs of FIG. 2 over a single 24-hour period.
Figure 4:
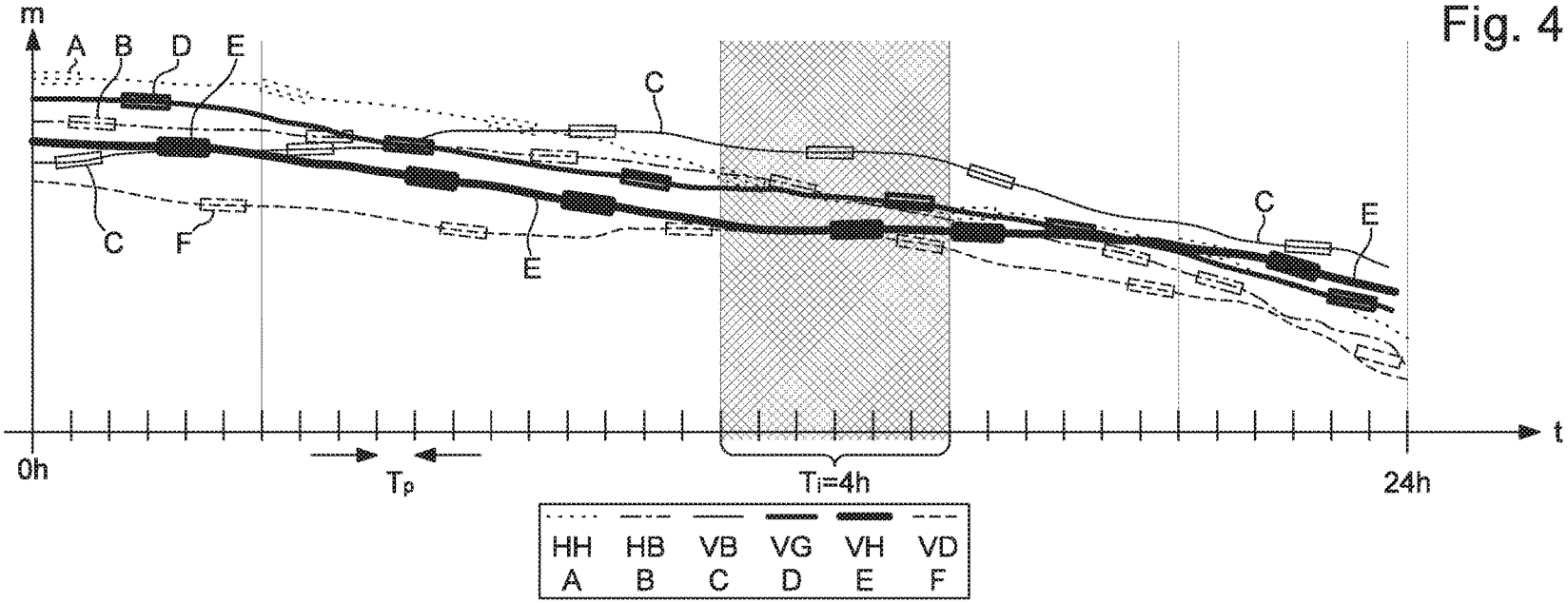
FIG. 4 is a similar diagram to that of FIG. 1, which relates to the method according to the invention, wherein the rate parameters are measured during successive, multi-position sequences, each with a duration of 4 hours, and in each of which the measurement is performed successively in chronometer testing positions, more specifically six positions in this non-limiting implementation of the invention.
Figure 5:
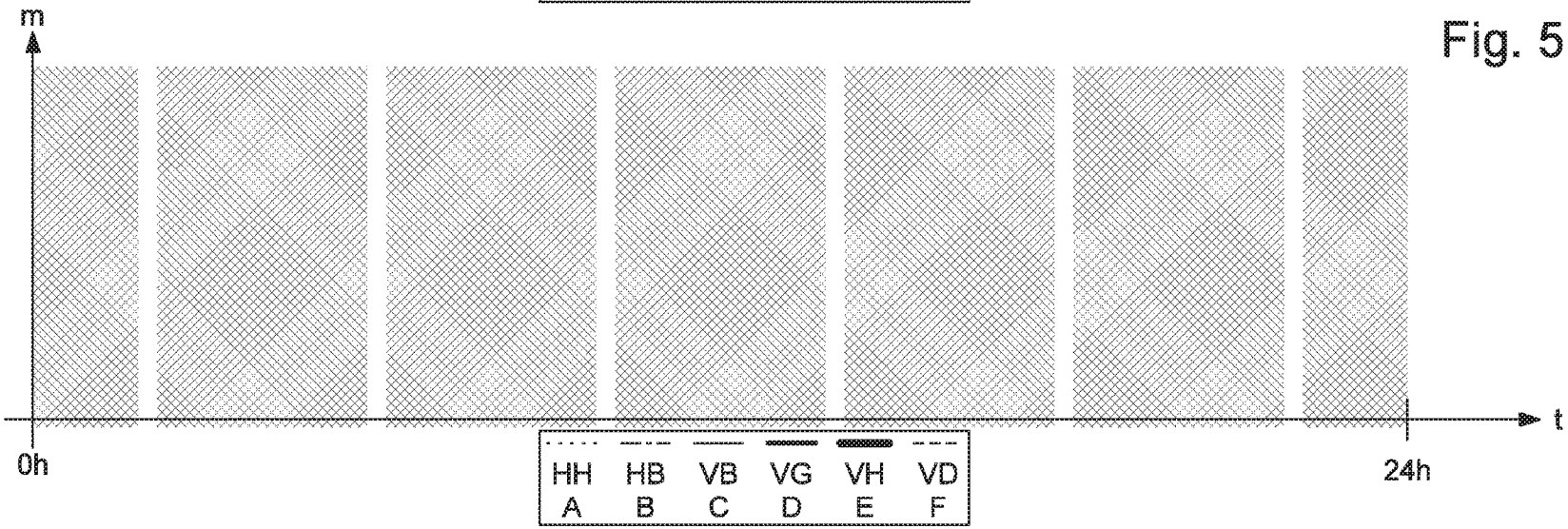
FIG. 5 is a simplified representation of the diagram of FIG. 4, in a variant wherein the successive, multi-position sequences are of irregular duration.
Figure 6:
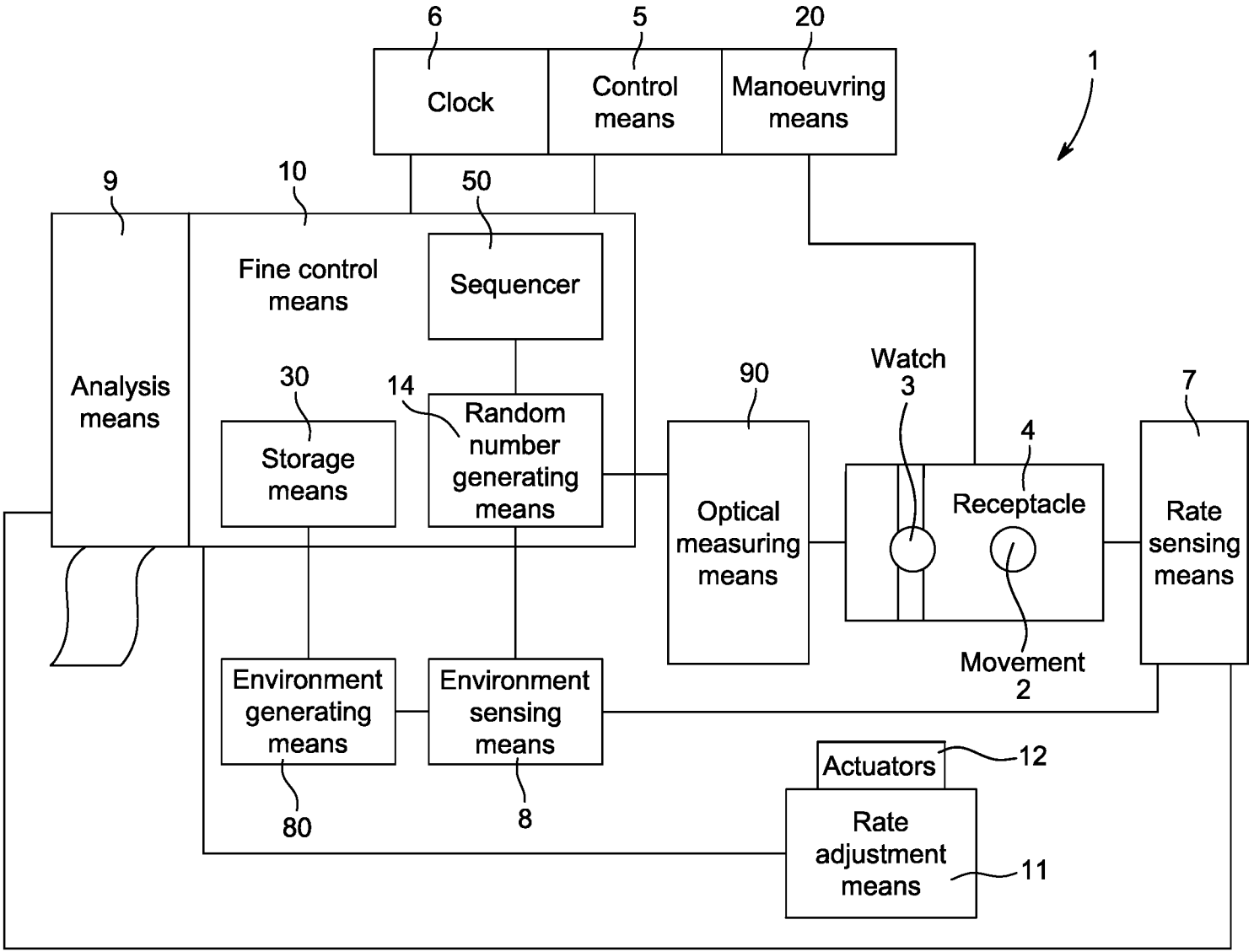
FIG. 6 is a diagram illustrating a device capable of implementing the method of FIG. 4 or 5.

The movement is measured for a total duration of 24 hours, or more, by continuously repeating a measurement sequence. FIGS. 4 and 5 show examples of the performance of this measurement method.

A standard sequence according to the invention includes: for a first position, 30 seconds of rate stabilisation, around 40 minutes of measurement in the first position, then a change of position and the rate stabilising and measuring operations are repeated, so as to cover the standard positions during a basic interval of duration Ti, or, more particularly, six positions, especially the six standard positions, in a non-limiting implementation of the invention illustrated by the Figures. It is understood that these measurements could be performed in any number of positions, less than or equal to or greater than the most common six standard positions. This measurement sequence is repeated several times over a total duration of at least 24 hours.

In the non-limiting case of FIG. 4, the basic interval of the sequence has a duration Ti equal to 4 hours, during which six measurements are made per position, each with a duration per position Tp of around 40 minutes. The 24 hours of analysis of the movement are thus divided into six measurement sequences each having a duration Ti of 4 hours. Each of these 4-hour measurement sequences is composed of six times 40 minutes of measurement per position.

The overall measurement duration is thus limited to the reasonable value of 24 hours, which makes it possible to monitor the effect of the gradual unwinding of the mainspring barrel, in six steps in the present case, and in each of the standard positions.

The invention thus offers the advantage of providing complete information about all the positions between instant 0 h and instant 24 h, for a measurement over 24 hours in total. As illustrated in FIG. 4, the split measurements represented by small rectangles make it possible to reconstruct the complete signal profile, as would be visible with a traditional 24-hour measurement per position. Indeed, despite the splitting of the measurement, the method according to the invention allows for clear characterization of the chronometric precision of the timepiece being measured.

Setting the durations of the measurement intervals is important. Indeed, the duration Tp of each measurement per position must not be too long, so that the first measurement 0 h of the last position VD (F in the Figures) is not too far from the initial instant of the overall measurement.

The example of FIG. 4 is a particular case where all intervals of duration Ti are identical. This is not, however, compulsory, and FIG. 5 illustrates a variant with intervals of irregular duration.

A statistical study of each calibre, performed beforehand, makes it possible to optimise the setting of interval durations.

It should be understood that, in a movement, the trains are not perfect, and the torque available at the escapement wheel is not constant, but fluctuates according to out-of-round defects of the wheels and pinions or tooth cutting defects, etc. This results in fluctuations in amplitude and rate. Account must be taken of these typical train variations when setting the interval durations. An interval that is too short has the drawback of measuring a local minimum or maximum and not the true mean value.

If the measurement intervals are too short, the rate stabilising time becomes proportionally too long. The measurement intervals must therefore be of sufficiently long duration.

Measuring the time taken to achieve a stabilise rate upon a change of position can advantageously form a new chronometer testing criterion, which is added to the usual elements of observation.

Measuring the rate and/or amplitude during the change of position can also form a "dynamic" measuring position. If necessary, the change of position can be extended and modified into a continuous movement of movement 2 or of watch 3 for a certain time interval in order to constitute a sufficiently long measuring position.

The method described above does not provide information about the position of the hands. Thus, it is advantageous to combine implementation of the method of the invention with a measurement of the daily rate, and to observe and note the state of the watch, at least at the start and end of the measurement, and advantageously also at intermediate stages. This observation of the state of the watch can be performed using one of the optical methods described by EP Patent No 10192725 in the name of The Swatch Group Research & Development Ltd.

It is especially advantageous to use the acoustic measurement to take photographs of the display at instants 0 h and 24 h, and also during any intermediate observations provided.

Of course, limiting the measurement to a total duration of 24 hours obeys production cost constraints, but it is clear that it is possible for observation of a movement according to the principle of the invention not to be limited to a measurement from 0 h to 24 h, but to be of longer duration, up to depletion of the power reserve, the duration of which can then easily be determined.

The measurement also makes it possible, in an innovative manner, to determine the duration of the power reserve of the watch, in combination with changes of position.

The duration spent in each position can also be weighted, to simulate typical wear.

This measurement makes it possible to accurately determine the characteristics of the watch. With this measurement, the daily rate can be calculated and simulated according to different types of wear, which makes it possible to certify a watch for a specific range of wear.

It is possible to store the acoustic signature of the movement throughout the test, and to check other properties of the movement or of the watch, such as operation of the calendar mechanism (change of date at midnight) or of any other function.

The measurement is advantageously combined with temperature changes, to define the coefficient C, and/or to simulate specific wear conditions, for example 16 hours at 33° C., then 8 hours at 23° C.

Likewise, the measurement is advantageously combined with variations in atmospheric pressure, or other physical parameters of the environment of the watch, such as the degree of humidity, or magnetic fields, or otherwise. To this end, environment generating means 80 are used, which are arranged to impose specific physical conditions where the measurement is carried out: temperature, humidity, magnetic field or otherwise.

In short, this measurement method makes it possible to characterize the chronometric properties of the watch in several positions in a relatively short measurement duration and can be accompanied by certification of the watch for specific physical conditions or at specified operating limits, and for specific types of wear.

The invention concerns a chronometric testing device 1 for a movement 2 of a watch 3, or of watch 3. This device 1 includes at least one receptacle 4, which is arranged to safely hold, up to a given acceleration threshold, at least one movement 2 or one watch 3.

Device 1 includes in an advantageous but non-limiting manner, multi-axis manoeuvring means 20, which are arranged to manoeuvre each receptacle 4 in space, and which are arranged to impose on each receptacle 4 an overall cycle that includes at least one cycle with a predefined trajectory under the control of control means 5 including a clock 6 or connected to an external time base. A "trajectory" means here all the position, orientation, speed and acceleration parameters of each receptacle 4: the geometric curve along which each receptacle 4 moves, and, on each point of this geometric curve, the angles of orientation of said receptacle 4 in space, and its speed and acceleration vectors.

This predefined cycle includes passing through all or part of the standard chronometer testing positions of the COSC Official Swiss Chronometer Testing Institute, or through the positions required for similar reference bodies: the Geneva Observatory, Besancon Observatory, Hamburg Observatory, Neuchatel Observatory, or suchlike. For example, the predefined cycle includes the six test positions: two horizontal positions 'HH' (dial up—A), 'HB' (dial down—B) and four vertical positions: 'VB' (pendant down—C), 'VG' (pendant left—D), VH' (pendant up—E), 'VD' (pendant right—F).

It is clear that the overall cycle can include more chronometric measurements than the traditional static positions, in particular to test the chronometric accuracy of movement 2 or of watch 3 dynamically, in a uniform movement, uniformly accelerated or decelerated, or otherwise, especially in a random movement. Advantageously, the overall cycle also includes observation of chronometric precision during a stabilisation phase immediately after stopping in a static position; the rate of instantaneous rate variation from the moment of stopping to the moment when the rate is regular and stabilised provides information about the movement, specific to the latter, which could even allow detection of counterfeits.

Manoeuvring means 20 are arranged to manoeuvre each receptacle 4 in space, and device 1 includes rate sensing means 7, which are arranged to record, particularly in an acoustic and/or optical manner, rate parameters for each movement 2 (or watch 3) placed in a receptacle 4 during a movement and/or an acceleration. The movements in space may be angular or curvilinear. More particularly, this recording is correlated with the recording of physical conditions of the environment in which the chronometric testing is carried out.

Device 1 includes fine control means 10 and analysis means 9, which are interfaced with control means 5, rate sensing means 7 and, in a particular variant, environment sensing means 8, and which are arranged to evaluate the behaviour during wear of each movement 2 or respectively of each watch 3, and more particularly to evaluate the chronometric precision of each movement 2 or respectively of each watch 3 in a kinematic and/or dynamic cycle applied to each receptacle 4. In particular, rate sensing means 7 are linked to environment sensing means 8 to record, in correlation with said recording of rate parameters, the physical conditions of the environment in which the chronometric testing is carried out and fine control means 10 and analysis means 9 are interfaced with control means 5, rate sensing means 7 and also environment sensing means 8.

According to the invention, these fine control means 10 and analysis means 9 are arranged to evaluate the chronometric precision of each movement 2, or respectively of each watch 3 in a kinematic and/or dynamic cycle applied to each receptacle 4 in various alternative configurations, which may also be combined within the same overall cycle:

- during a motion of receptacle 4 wherein the centre of inertia of movement 2 or respectively of watch 3 has a variable position: the movement or watch moves;
- during an angular motion of receptacle 4 wherein the centre of inertia of movement 2 or respectively of watch 3 has a fixed position: the movement or watch rotates about its centre of gravity;
- during a stabilisation phase after the centre of inertia has reached a fixed position, in a fixed position of the centre of inertia of movement 2 or respectively of watch 3 and after cancellation of its linear and angular speed vectors and its acceleration, and during which stabilisation phase the rate is variable: the movement or the watch is entirely immobile during said stabilisation phase;
- during a stop phase wherein the centre of inertia of movement 2 or respectively of watch 3 is in a fixed position and wherein the linear and angular speed vectors and acceleration are all zero, and in which stop phase the rate is stable: the movement or the watch is totally immobile in said stop phase.

More particularly, fine control means 10 and analysis means 9 are also arranged to issue a certificate of inspection in the event that all the measured values meet predefined tolerances, or otherwise to start another iterative process to resume rate adjustment and testing.

According to the invention, fine control means 10 include a sequencer 50, which is arranged to control the chronometric position changes of movement 2, or respectively of watch 3, in a multi-position sequence, with a change of chronometric position after each measurement per position, and to start another a multi-position sequence as soon as the preceding sequence finishes and which observes the predefined total duration of one cycle of several successive multi-position sequences.

This sequencer 50 is also arranged to manage the rate stabilisation duration Ts, duration of measurement per position Tp, and multi-position sequence interval duration Ti defining a basic interval in which a chronometric test is performed in each of the predefined chronometric positions.

Rate stabilisation durations Ts are conventionally a few seconds, and especially but not limited to between 20 seconds and 30 seconds.

Fine control means 10 include storage means 30, which are arranged to store tolerance and threshold value parameters and/or to store duration parameters and physical condition parameters representative of specific types of wear, and to this end, are advantageously coupled with environment sensing means 8 and with environment generating means 80, which are arranged to impose specific physical conditions where the measurement is carried out: temperature, humidity, magnetic field or otherwise.

Advantageously, fine control means 10 and storage means 30 are arranged to weight the time spent in each position to simulate a specific wear type.

More particularly, device 1 includes optical measuring means 90 for measuring the state of certain displays of movement 2 or respectively of watch 3, in correlation with internal clock 6 and which are advantageously coupled with storage means 30.

More particularly, device 1 includes rate adjustment means 11, and fine control means 10 are arranged to send control signals to actuators 12 comprised in rate adjustment means 11, to correct the operation of adjustment means comprised in a resonator of movement 2 or respectively of watch 3, before carrying out at least one new predefined test cycle.

In a variant, fine control means 10 include a display that can communicate instructions to a watch technician for adjusting the resonator of movement 2 or of watch 3.

More specifically, when all the tests carried out meet the predefined chronometric criteria, fine control means 10 are arranged to issue a document, which is the certificate of chronometric precision for the movement 2 concerned (or watch 3 as appropriate). In particular, fine control means 10 and analysis means 9 are arranged to issue a certificate of inspection in the event that all the measured values meet predetermined tolerances, or otherwise to start another iterative process to resume rate adjustment and testing.

More specifically, fine control means 10 are arranged to impose on the sequencer specific durations of measurement per position Tp, and/or specific multi-position sequence durations Ti. More specifically, the specific durations of measurement per position Tp are irregular within the same multi-position sequence. More specifically, the specific durations of multi-position sequences are irregular within the overall rate test cycle.

In a variant, fine control means 10 include random number generating means 14 arranged to generate random durations, within predefined ranges, for the measurement durations per position Tp, and/or multi-position sequence durations Ti, transmitted to sequencer 50.

More specifically, rate sensing means 7 and environment sensing means 8 are arranged to subject movement 2, or respectively watch 3, to additional predefined or random additional validation tests, especially in relation to environment generating means 80.

More specifically, and in a non-limiting manner, rate sensing means 7 are acoustic, such as a microphone or similar, or optical, such as a camera.

In a particular variant, rate adjustment means 11 include a robotic manipulator, capable of intervening by tightening a regulator screw, moving and/or rotating a balance spring stud, by deforming or moving banking pins for the active portion of a balance spring, through the action of a laser beam on a balance spring or on a balance, or suchlike.

Thus the invention concerns a method for testing the chronometric precision of a movement 2 of a watch 3, or of a watch 3, wherein motions are imposed on a receptacle 4 carrying movement 2, or respectively watch 3, including at least one cycle with a predefined trajectory under the control of control means 5 including a clock 6 or connected to an external time base, wherein the cycle includes passing through standard chronometric testing positions. This cycle includes, with a predefined minimum duration, a plurality of successive multi-position sequences, in each of which movement 2, or respectively watch 3, is positioned in succession in one of the standard positions for a first, rate stabilisation phase and a second, rate testing phase during one measurement per position. The rate parameters of movement 2, or respectively of watch 3, are measured in the positions in each of the successive multi-position sequences. The rate parameters are also compared to desired values.

More specifically, chronometric testing is performed during a motion of receptacle 4 wherein the centre of inertia of movement 2, or respectively of watch 3, has a variable position, during an angular motion of receptacle 4 wherein the centre of inertia of movement 2, or respectively of watch 3, has a fixed position, during a stabilisation phase once the centre of inertia of movement 2, or respectively of watch 3, has reached a fixed position and after cancellation of its linear and angular speed vectors and its acceleration, and during which stabilisation phase the rate is variable; And during a stop phase wherein the centre of inertia of movement 2 or respectively of watch 3 is in a fixed position and wherein the linear and angular speed vectors and acceleration are all zero, and in which stop phase the rate is stable.

More specifically, fine control means 10 are implemented, including a sequencer 50, which is arranged to control the chronometric test position changes of movement 2, or respectively of watch 3, in a multi-position sequence after each measurement per position, and to start another multi-position sequence as soon as the preceding sequence finishes and which observes the predefined total duration of one cycle of several successive multi-position sequences, sequencer 50 is also arranged to manage rate stabilisation durations Ts, durations of measurement per position Tp, and multi-position sequence interval durations Ti defining a basic interval in which a chronometric test is performed in each of the predefined chronometric positions.

More specifically, the duration spent in each position is weighted to simulate typical wear.

In a particular implementation, a certificate of inspection is issued in the event that all the measured values meet predefined tolerances. In a particular implementation, another iterative process to resume rate adjustment and testing is started.

More particularly, the rate of movement 2, or respectively of watch 3, is measured for a total duration of at least 24 hours, by continuously repeating a multi-position measuring sequence, which includes, for a first position, 30 seconds of rate stabilisation, 40 minutes of measurement in the first position, then a change of position and the rate stabilising and measuring operations are repeated, so as to cover the standard positions during a basic interval with a 4 hour duration Ti.

In a variant, all the basic intervals are of identical duration Ti.

In another variant, the basic intervals have irregular durations.

More specifically, rate testing is combined with a measurement of the daily rate, observing the state of the watch at least at the start and the end of the measurement, using an optical method.

More particularly, the acoustic measurement is used to take photographs of the display at instants 0 h and 24 h.

More particularly, the power reserve of the watch is determined, in combination with changes of position.

More particularly, the acoustic signature of movement 2, or respectively of watch 3, is recorded throughout the test, and the working of the calendar mechanism is simultaneously tested, with the change of date at midnight when movement 2, or respectively watch 3, includes such a mechanism.

More particularly, the rate measurement is combined with variations in the physical conditions of the environment of the watch, which are imposed by environment generating means 80, arranged to impose specific temperature and/or humidity and/or magnetic field conditions.

More particularly, rate sensing means 7 are used to continuously or discontinuously record the rate parameters of each movement 2, or respectively watch 3, placed in a receptacle 4 which is set in motion to make each movement 2, or respectively each watch 3, take different positions in space.

More particularly, rate sensing means 7 are used, together with environment sensing means 8, to continuously or discontinuously record, in correlation with said recording of rate parameters, the physical conditions of the environment in which the chronometric testing is carried out, and fine control means 10 and analysis means 9 are used, interfaced with control means 5, rate sensing means 7 and environment sensing means 8.

More particularly, fine control means 10 and analysis means 9 are used, interfaced with control means 5 and rate sensing means 7 and arranged to evaluate the chronometric precision, for a specific type of wear, of each movement 2, or respectively of each watch 3, to issue a certificate of inspection in the event that all the measured values meet predetermined tolerances, or otherwise to start another iterative process to resume rate adjustment and testing.

More particularly, fine control means 10 and analysis means 9 are used to evaluate the chronometric precision of each movement 2, or respectively of each watch 3, in a kinematic and/or dynamic cycle applied to each receptacle 4.

More particularly, a kinematic and/or dynamic cycle is generated to simulate a specific type of wear, either in a random cycle, or in a dynamic position, or in a stabilisation position following a change of position.

More particularly, fine control means 10 include random number generating means 14 arranged to generate random durations, within predefined ranges, for the durations of measurement per position Tp, and/or multi-position sequence durations Ti.

The invention claimed is:

1. A method for testing the chronometric precision of a watch movement, or of a watch, comprising:

imposing motions on a receptacle carrying said movement, or respectively said watch, in an overall cycle including at least one cycle with a predefined trajectory, wherein said at least one cycle with the predefined trajectory includes passing through standard chronometric test positions, wherein said overall cycle includes, with a predefined minimum duration, a plurality of successive multi-position sequences, in each of which said movement, or respectively said watch, is positioned in succession in one of said standard positions for a rate stabilisation phase and a rate testing phase in one measurement per position, and wherein the rate parameters of said movement, or respectively of said watch, are measured in said positions in each of said successive multi-position sequences, and wherein said rate parameters are compared to desired values.

2. The chronometric testing method according to claim 1, wherein the chronometric testing is performed during a motion of said receptacle wherein the centre of inertia of said movement, or respectively of said watch is in a variable position, during an angular motion of said receptacle wherein the centre of inertia of said movement or respectively of said watch is in a fixed position, during a stabilisation phase once the centre of inertia of said movement, or respectively of said watch, has reached a fixed position and after its linear and angular speed vectors and its acceleration reach zero, and during which stabilisation phase the rate is variable, and during a stop phase wherein the centre of inertia of said movement, or respectively of said watch, is in a fixed position and wherein the linear and angular speed vectors and acceleration are all zero, and in which stop phase the rate is stable.

3. The chronometric testing method according to claim 1, wherein including a sequencer is arranged to control the changes of chronometric test position of said movement, or respectively of said watch, in a multi-position sequence after each measurement per position, and to start another multi-position sequence as soon as the preceding sequence finishes and which observes the predefined total duration of one cycle of several successive multi-position sequences, said sequencer also being arranged to manage the rate stabilisation durations, durations of measurement per position, and durations of multi-position sequence intervals defining a basic interval in which a chronometric test is performed in each of the predefined chronometric positions.

4. The chronometric testing method according to claim 3, wherein said basic intervals all have an identical duration.

5. The chronometric testing method according to claim 3, wherein said basic intervals have irregular durations.

6. The chronometric testing method according to claim 1, wherein the time spent in each position is weighted to simulate a type of wear.

7. The chronometric testing method according to claim 1, wherein a certificate of inspection is when all the measured values meet predetermined tolerances, or in that otherwise another iterative process is started to resume rate adjustment and testing.

8. The chronometric testing method according to claim 1, wherein the rate of said movement, or respectively of said watch, is measured for a total duration of 24 hours, by continuously repeating a said multi-position measuring sequence, which includes, for a first position, 30 seconds of rate stabilisation, 40 minutes of measurement in the first position, then a change of position and the rate stabilising and measuring operations are repeated, so as to cover said standard positions during a basic interval having a 4 hour duration.

9. The chronometric testing method according to claim 1, wherein rate testing is combined with a measurement of the daily rate, observing the state of the watch at least at the start and the end of the measurement, using an optical method.

10. The chronometric testing method according to claim 9, wherein the measurement of the daily rate includes taking photographs of the display at instants 0h and 24h.

11. The chronometric testing method according to claim 1, wherein a power reserve of the watch is determined in combination with position changes.

12. The chronometric testing method according to claim 1, wherein an acoustic signature of said movement, or respectively of said watch, is recorded throughout the test, and the working of the calendar mechanism is simultaneously tested, with the change of date at midnight, when said movement, or respectively said watch, includes such a mechanism.

13. The chronometric testing method according to claim 1, wherein the rate measurement is combined with variations in the physical conditions of the environment of the watch, including specific temperature and/or humidity and/or magnetic field conditions.

14. The chronometric testing method according to claim 1, wherein rate sensing means are used to continuously or discontinuously record the rate parameters of each movement, or respectively watch, placed in a receptacle, which is set in motion to make each movement, or respectively each watch, take different positions in space.

15. The chronometric testing method according to claim 14, further comprising continuously or discontinuously recording, in correlation with said recording of rate parameters, the physical conditions of the environment in which said chronometric testing is carried out.

16. The chronometric testing method according to claim 15, further comprising evaluating the chronometric precision, according to a specific type of wear, of each movement, or respectively of each watch, to issue a certificate of inspection in the event that all the measured values meet predetermined tolerances, or otherwise to start another iterative process to resume rate adjustment and testing.

17. The chronometric testing method according to claim 15, wherein the chronometric precision of each said movement, or respectively of each said watch, is evaluated in a kinematic and/or dynamic cycle applied to each said receptacle.

18. The chronometric testing method according to claim 17, wherein said kinematic and/or dynamic cycle is generated to simulate a specific type of wear, either in a random cycle, or in a dynamic position, or in a stabilisation position following a change of position.

19. The chronometric testing method according to claim 15, wherein a sequencer, which is arranged to control the changes of chronometric test position of said movement, or respectively of said watch, in a multi-position sequence after each measurement per position, and to start another multi-position sequence as soon as the preceding sequence finishes and which observes the predefined total duration of one cycle of several successive multi-position sequences, said sequencer also being arranged to manage the rate stabilisation durations, durations of measurement per position, and durations of multi-position sequence intervals defining a basic interval in which a chronometric test is performed in each of the predefined chronometric positions, and wherein said fine control means include random number generating means arranged to generate random durations, within predefined ranges, for the durations of measurement per position, and/or multi-position sequence durations.

20. The chronometric testing method according to claim 14, wherein said rate sensing means includes a microphone or a camera.

* * * * *